US005558609A

United States Patent [19]

Olschansky et al.

[11] Patent Number: 5,558,609

[45] Date of Patent: Sep. 24, 1996

[54] GLUTEAL AND THIGH MUSCLE EXERCISE SYSTEM

[76] Inventors: Brad Olschansky; Scott Olschansky, both of 2003 Lake Park Dr. Apt. H, Smyrna, Ga. 30080

[21] Appl. No.: 338,110

[22] Filed: Nov. 9, 1994

[51] Int. Cl.[6] ..... A63B 21/02

[52] U.S. Cl. ..... 482/122; 482/124; 482/125

[58] Field of Search ..... 482/51, 121, 122, 482/124, 125, 129, 140, 907

[56] References Cited

U.S. PATENT DOCUMENTS

| | | | |
|---|---|---|---|
| 539,872 | 5/1895 | Kheiralla | 482/51 |
| 807,908 | 12/1905 | Bradstreet | 582/51 |
| 843,478 | 2/1907 | Müller | 482/124 |
| 866,495 | 9/1907 | Marks | 482/124 |
| 1,618,273 | 2/1927 | Davidson | 482/124 |
| 1,677,728 | 7/1928 | Robinson | 482/51 |
| 4,736,946 | 4/1988 | Gordon | 482/125 |
| 4,955,608 | 9/1990 | Dougherty et al. | 482/124 |
| 5,062,642 | 11/1991 | Berry et al. | 482/124 |
| 5,336,151 | 8/1994 | Van Ballegooie | 482/124 |

FOREIGN PATENT DOCUMENTS

| | | | |
|---|---|---|---|
| 579583 | 1/1994 | European Pat. Off. | 482/121 |
| 21490 | of 1906 | United Kingdom | 482/124 |
| 18341 | of 1908 | United Kingdom | 482/124 |

*Primary Examiner*—Richard J. Apley

*Assistant Examiner*—Jeanne M. Clark

*Attorney, Agent, or Firm*—Morton J. Rosenberg; David I. Klein

[57] ABSTRACT

A system (100) particularly directed to exercising gluteal and thigh muscles is provided. System (100) includes a longitudinally extended handle member (110) and an assembly (150) for engaging a heel portion of a user's foot. A resistive force assembly (120) is coupled on a first end to a central portion of the handle member (110) and on an opposing second end to the heel engagement assembly (150). The resistive force assembly (120) includes an inelastic resistive force subassembly having an inelastic strap member (132) coupled on a first end (138) to handle member (110) and a second end (136) formed in a closed contour. Inelastic resistive force subassembly (130) includes an adjustment buckle (135) for adjusting an overall length dimension of the inelastic strap member (132). Resistive force assembly (120) includes an elastic resistive force subassembly (140) defined by an elastic strap member (142) having opposing ends thereof coupled to a heel engagement assembly (150) and an intermediate section thereof slidingly coupled to the closed contoured end (136) of inelastic strap member (132). Heel engagement assembly (150) includes a first band member (152) coupled on opposing ends to respective opposing ends (147, 149) of elastic strap member (142), a second band member (154) coupled on opposing ends to respective opposing ends of band member (152), and extending in a transverse direction relative thereto, and a third band member releasably coupled between opposing ends of the first band member (152).

6 Claims, 5 Drawing Sheets

GLUTEAL AND THIGH MUSCLE EXERCISE SYSTEM

BACKGROUND OF THE INVENTION

1. Field of the Invention

This invention directs itself to exercise systems for exercising the muscles of the lower body. In particular, this invention directs itself to a portable exercise system having a resistive force assembly coupled between a handle member and a foot engaging assembly. More in particular, this invention pertains to an exercise system having a heel engaging assembly for engagement with a user's foot for maintaining the application of resistive force in substantial alignment with the load bearing axis of a user's leg. Further, this invention directs itself to an exercise device for exercising gluteal and thigh muscles wherein the resistive force assembly includes an assembly for adjusting the initial resistive force applied to the user's foot by means of adjusting an initial displacement dimension between the heel engagement assembly and a handle member.

2. Prior Art

Lower body exercise systems are known in the art. Prior art lower body exercise systems typically were formed by a single elastic strap member coupled on opposing ends to handle-like structures which may be engaged by the hands or feet of the user. When engaged with the user's foot, such are typically disposed in proximity of the ball portion of the user's foot, thereby providing a significant torque on the user's ankle joint. Such systems further are subject to unintended disengagement with the user's foot, as they are not stably secured thereto. Where the elastic resistive force member itself is passed about a user's foot, with handle-like structures being grasped by the user's hands, such also suffer from an inability to stably maintain the elastic member properly positioned in alignment with the load bearing axis of the user's leg and also subject to unintended disengagement.

In still other prior art systems, an elastic member is provided in a closed contour without any specific foot engagement or handle members. Such systems likewise suffer from the potential disengagement from the user's foot and an inability to maintain the force loading in proper alignment with the user's body. Further, none of these prior art systems provide any means for adjusting the initial length of the resistive force member nor do they disclose a resistive force structure which includes both an elastic and an inelastic member.

SUMMARY OF THE INVENTION

A device for exercising gluteal and thigh muscles is provided. The exercise device includes a longitudinally extended handle member and an assembly for engaging a heel portion of a user's foot. The exercising device further includes an assembly coupled on a first end to the handle member and on an opposing second end to the heel engagement assembly for providing a resistive force therebetween. The resistive force assembly includes an assembly for adjusting an initial displacement dimension of the heel engagement assembly relative to the handle member.

It is an object of the invention to provide an exercise system which provides a stable and secure means of coupling to a user's foot.

It is another object of the invention to provide a heel engagement assembly for releasably and securely coupling the resistive force structure to a heel portion of the user's foot.

It is a further object of the invention to provide a heel engagement structure which provides for application of a resistive force in substantial alignment with the user's ankle and load bearing axis of the user's leg.

It is a still further object of the invention to provide a resistive force assembly which includes both an inelastic strap member and an elastic strap member, coupled one to another.

It is yet a further object of the invention to provide a resistive force structure having an ability to adjust an initial displacement dimension of the heel engagement portion thereof relative to a handle member.

These and other advantages and novel features of the invention will become apparent from the following detailed description when considered in connection with the accompanying drawings wherein:

DESCRIPTION OF THE PREFERRED EMBODIMENT

Referring to FIGS. 1–7, there is shown gluteal and thigh muscle exercise system 100 for providing a safe and effective means of exercising gluteal and thigh muscle groups. As will be seen in following paragraphs, system 100 is specifically directed to the concept of providing a resistive force to a user's leg which is balanced, that is, where the resistive force is applied substantially equally on opposing sides of the user's leg. System 100 is not restricted to exercising muscle groups of the lower body, as many upper body exercises may be performed using system 100. However, system 100 is particularly adapted to applying a resistive force in axial alignment with a user's ankle and load bearing axis of the user's leg to provide safe loading thereof. Additionally, system 100 provides for adjustability of the initial resistive force against which the user displaces their limbs.

Figures 1, 1A, 1B, 1C:
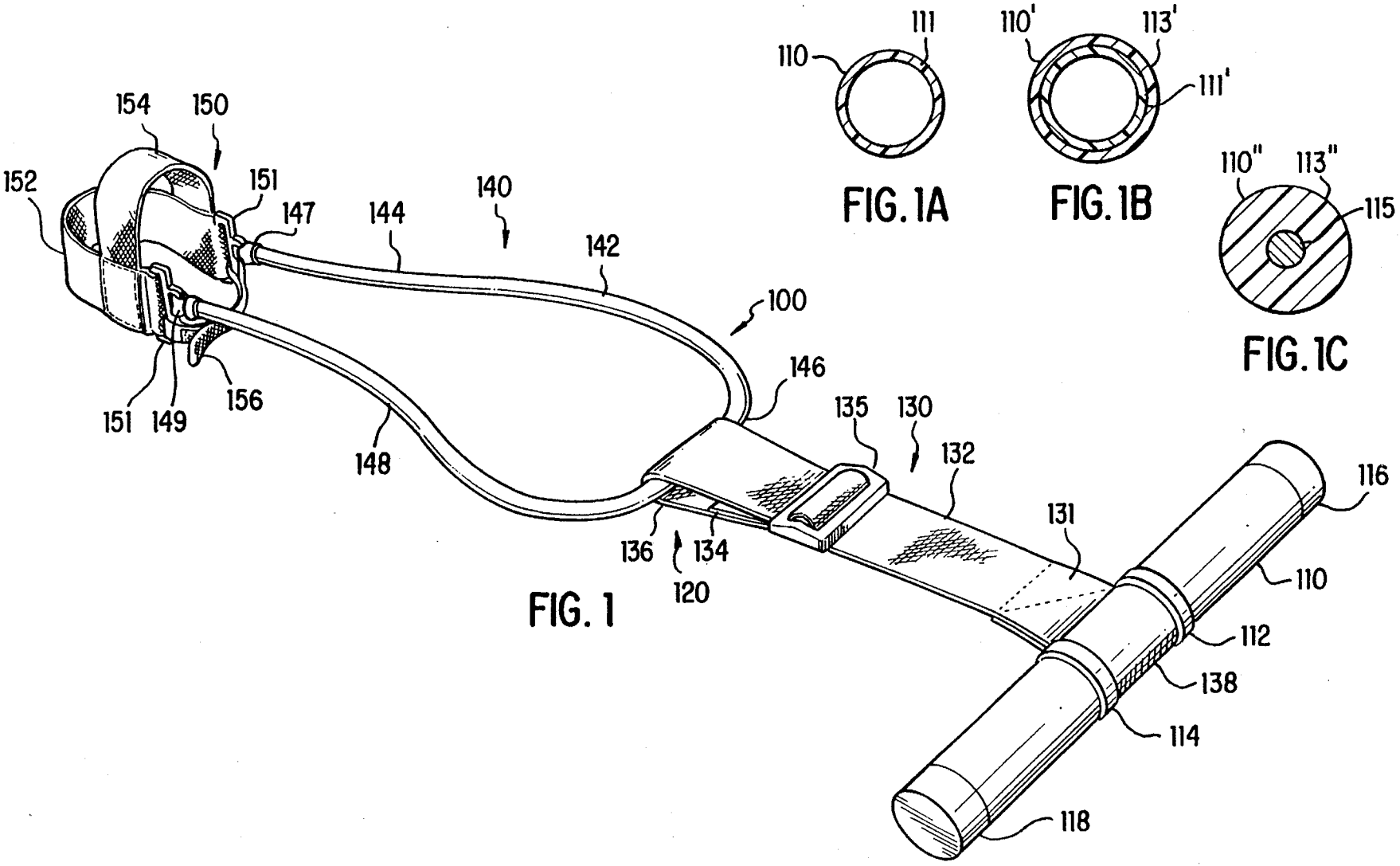
FIG. 1 is a perspective view of the exercise system.
FIG. 1A is a cross-sectional view of the handle of the exercise system.
FIG. 1B is a cross-sectional view of an alternate handle configuration of the exercise system.
FIG. 1C is yet another alternate configuration of the handle member of the exercise system.

Gluteal and thigh muscle exercise system 100 includes a longitudinally extended handle member 110, a heel engagement assembly 150 and a resistive force assembly 120, as is shown in FIG. 1. As will be discussed in following paragraphs, both the resistive force assembly 120 and heel engagement assembly 150, both alone and in combination, provide particular advantages to users of system 100. Together, those elements provide for the application of a loading force to user's leg, such being applied in a safe and effective manner. The resistive force assembly 120 includes an inelastic resistive force subassembly 130 and an elastic resistive force subassembly 140. Inelastic resistive force subassembly 130 provides the means by which the initial resistive force can be adjusted, as well as providing a body contacting portion of the resistance assembly 120 which will not abrade or cause chafing to the user's skin as the foot engagement assembly 150 is displaced relative to the handle member 110, during exercise. The foot engagement assembly 150 uniquely provides for proper alignment of the resistive force with a load bearing axis of a user's leg, as well as substantially preventing accidental disassociation of the resistive force assembly from the user's leg.

Figure 2:
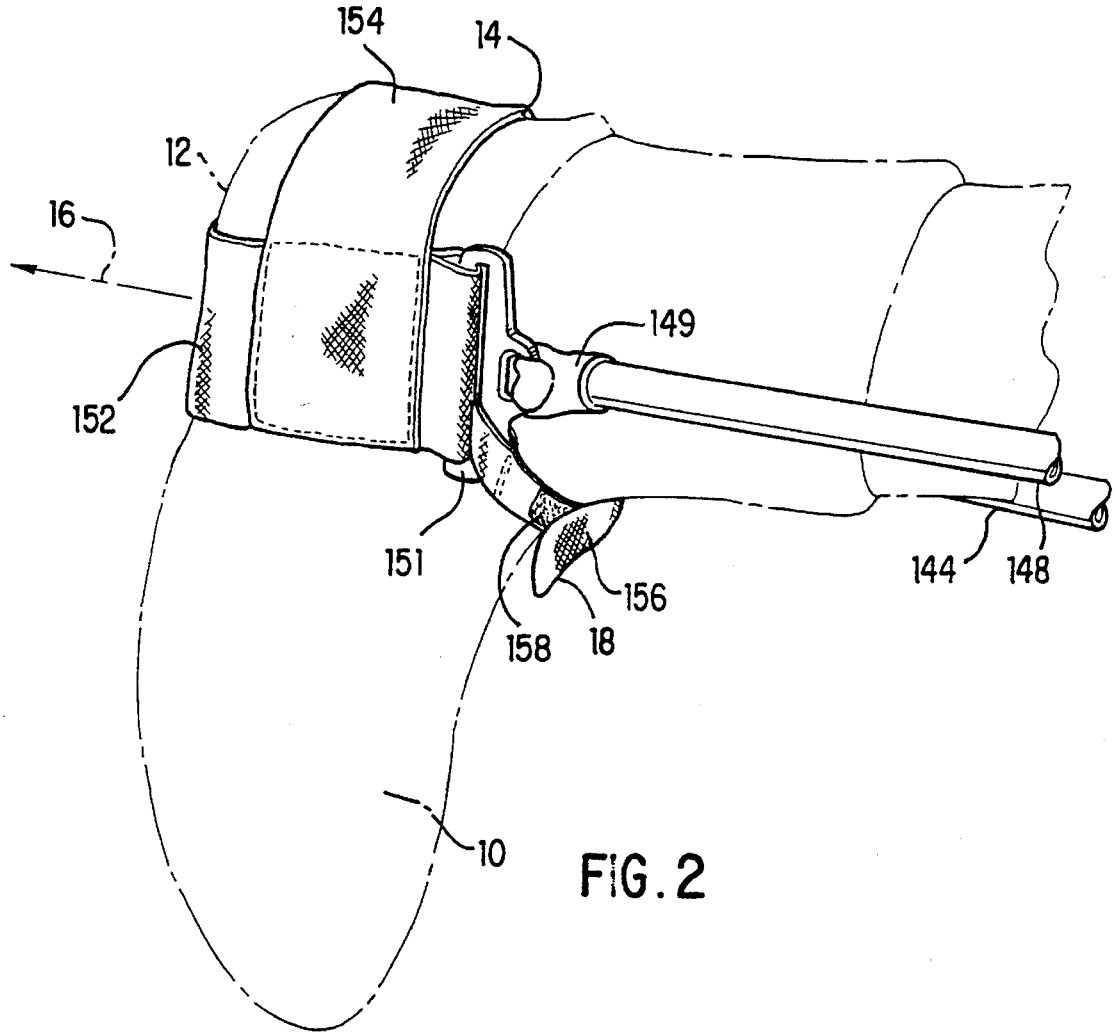
FIG. 2 is an enlarged perspective view showing the heel engagement assembly in relation to a user's foot.
Figure 3:
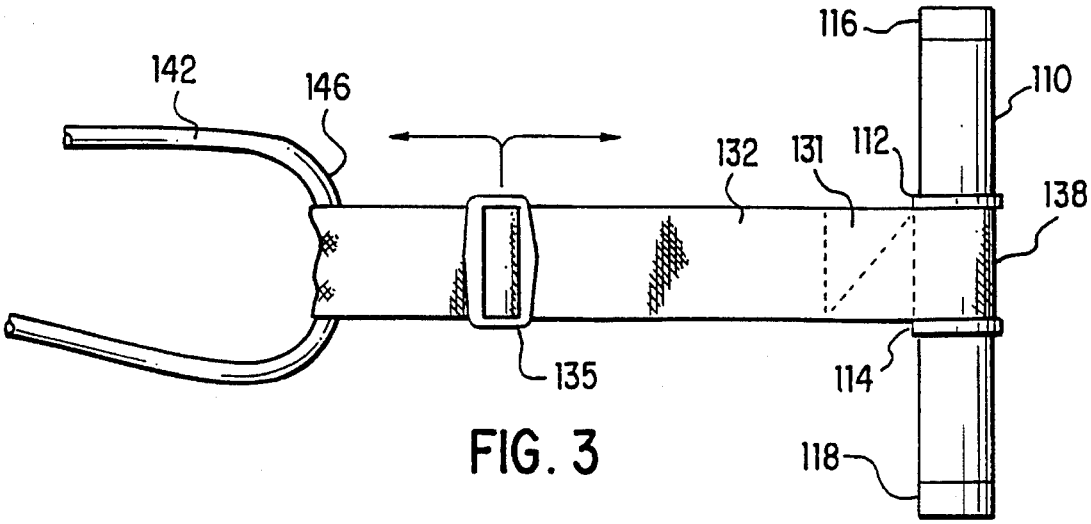
FIG. 3 is a partial plan view of the exercise system.

Referring now to FIGS. 1–3, there is shown resistive force assembly 120 coupled to the handle 110. Handle 110 has a longitudinally extended, substantially cylindrical contour which may have a diameter in the approximate range of 0.75–1.5 inches, or more, depending on its particular structure and composition. In its simplest form, handle member 110 may be formed by a tubular member 111 having sufficient wall thickness to provide the necessary structural integrity to withstand the tensile loading of the resistive force assembly 120. Obviously, the member 111 may also be formed by a solid member, as opposed to tubular. The member 111 is ideally formed of a plastic material composition, however, may also be formed of such materials as metal or wood. Alternately, handle 110', shown in cross-section in FIG. 1B, may be formed by a tubular member 111' which is overlaid by a compressible foamaceous layer 113' for improving the hand grip surface thereof. Still further, an alternate handle configuration 110", shown in cross-section in FIG. 1C, may be provided wherein a solid metallic core 115 has a diameter approximating 0.25 inches. This inner core is overlaid by a compressible foamaceous layer 113" which may have an outer diameter within the approximating range of 0.75–1.5 inches.

The resistive force assembly 120 is coupled to a central portion of handle 110, and prevented from being slidingly displaced therefrom by a pair of collar members 112 and 114, disposed on opposing sides thereof. Prevention of the end 138 of strap 132 from sliding laterally on handle 110 is of particular importance during upper body exercising, like that shown in FIG. 8, where handle 110 may not be maintained parallel to the floor. Where handle member 110 is formed with a compressive foamaceous layer 113', 113" the resistive force assembly 120 may be coupled to the structural portion 111', 115 of handle 110 and the collar members 112, 114 eliminated or integrally formed in the foamaceous layer. Handle 110 may also be provided with a pair of end caps 116 and 118 disposed on opposing longitudinal ends thereof.

Resistive force assembly 120 includes an inelastic resistive force subassembly 130 and an elastic resistive force subassembly 140. Inelastic resistive force subassembly 130 is defined by a strap member 132 formed of an inelastic flexible web having a first end 138 secured to the central portion of handle member 110.

Strap member 132 is typically coupled to handle 110 by wrapping the end of the web around the member 111 and securing it to a remaining portion of the web to form a joint 131. Such provides a pivotal coupling, allowing the joint to move rotatively around the handle, which prevents non-uniform loading of joint 131 when strap 132 is being angularly directed from the handle 110. During many exercises, like that shown in FIG. 6, the handle 110 is pressed against a base surface. Collar members 112, 114 space the web at first end 138 away from the base surface, permitting joint 131 to pivot and maintain alignment with the remaining portion of strap 132.

The opposing second end 136 of the strap member 132 is formed in a closed contour to provide a slidable coupling with the elastic resistive force subassembly 140. The length of the strap member 132 between opposing ends 136, 138 is made adjustable by means of a buckle member 135 through which an end 134 of the web which forms strap 132 is threaded to form a closed contour loop of adjustable size, as is conventional in the art. Although such means of adjusting strap length is well known in the art, when combined with the elastic resistive force subassembly 140, such provides a critically important contribution to the operability and advantages of system 100, as will be further described.

Elastic resistive force subassembly 140 is defined by an elastic strap member or cord 142 having a pair of opposing ends 147, 149 coupled to the heel engagement assembly 150. An intermediate section 146 of the elastic strap member 142 extends through the closed contour second end 136 of strap member 132, to provide a slidable coupling therebetween. By this arrangement, the elastic strap member 142 is divided into an extendable section 144 which is disposed on one side of a user's leg and another extendable section 148 which is disposed on an opposing side of the user's leg. The slidable coupling between the intermediate section 146 and the looped end 136 of the strap member 132 permits the resistive force provided by the elastic strap 142 to be equally divided between the two extendable sections 144 and 148, to thereby provide a balanced loading on opposing sides of the user's leg. This balanced force loading is particularly advantageous to a user of system 100, as such does not apply load forces to the user's joints, ankles and knees, in a direction which is potentially injurious, as by creating torques thereon which could injure the user. By dividing the load between a pair of extendable portions 144, 148 the resistive force provided thereby is balanced and aids in maintaining the resistive force in substantial alignment with the natural load bearing axis 16 of the user's leg.

The heel engagement assembly 150 further aids in maintaining the alignment of the resistive forces provided by the resistive force assembly 120 in substantial alignment with the natural load bearing axis 16 of the user's leg. In particular, the opposing ends 147, 149 of the elastic strap member 142 are coupled to a first band member 152 of the heel engagement assembly 150. First band member 152 extends around the inferior tarsal portion 12 of a user's foot 10, and is aided in maintaining that position by means of a second band member 154 which is coupled on opposing ends to the respective opposing ends of the first band member. The second band member 154 extends in a direction which is transverse to the first band member and engages a posterior heel (tarsal) portion 14 of the user's foot 10. As the user displaces their foot relative to the handle 110 the first and second band members 152, 154 are tensioned, thereby firmly engaging the heel portion of the user's foot.

Each of the opposing ends of first band member 152 may be provided with an interconnecting member 151 to permit secure coupling of the respective elastic strap ends 147, 149 therewith. Interconnecting member 151 may be provided with an elongated slotted through opening of sufficient size to accommodate the passage of strap member 152 therethrough, and a smaller opening centrally located with respect to the opposing longitudinal ends of the member 151 for coupling with a respective end 147, 149 of the elastic strap member 142, for applying resistive forces uniformly to strap member 152. The combination of strap members 152 and 154, in addition to providing a more secure means of maintaining the resistive force assembly 120 coupled to a user's foot, aid in locating the application of the resistive force in substantial alignment with the user's ankle. The positive locating of the heel engagement assembly 150 and its securement to a user's foot is in contradistinction to prior art systems wherein a single loop provided coupling with the foot, which was likely to slip off the foot, or permit the user to apply the resistive force on the ball of the foot, resulting in significant torsional loading of the user's ankle joint.

Heel engagement assembly 150 may be further aided in its securement to the user's foot 10 by means of a third band member 156. Band member 156 may be provided to extend between opposing ends of first band member 152, extending across a superior tarsal portion 18 of the user's foot 10. Third band member 156 is releasably coupled to at least one of the opposing ends of first band member 152. In a preferred embodiment, third band member 156 extends between the opposing interconnecting members 151 and is releasably secured thereto by means of a fastener 158, which may be a hook-and-loop type fastening system, as is well known in the art.

Figure 4:
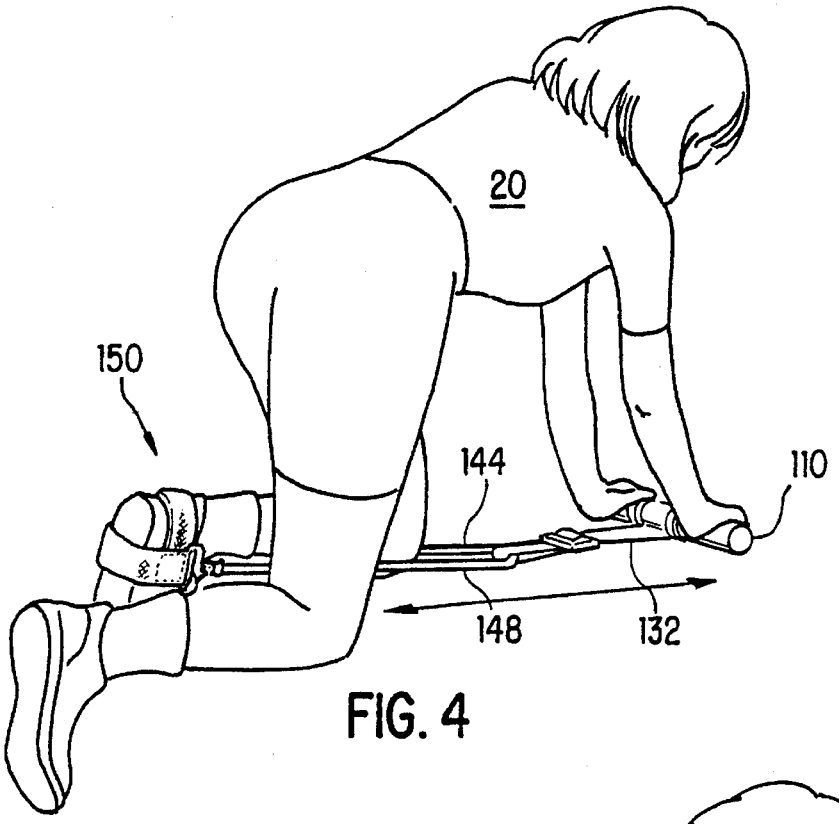
FIGS. 4–8 are depictions of the use of the exercise system.
Figure 5:
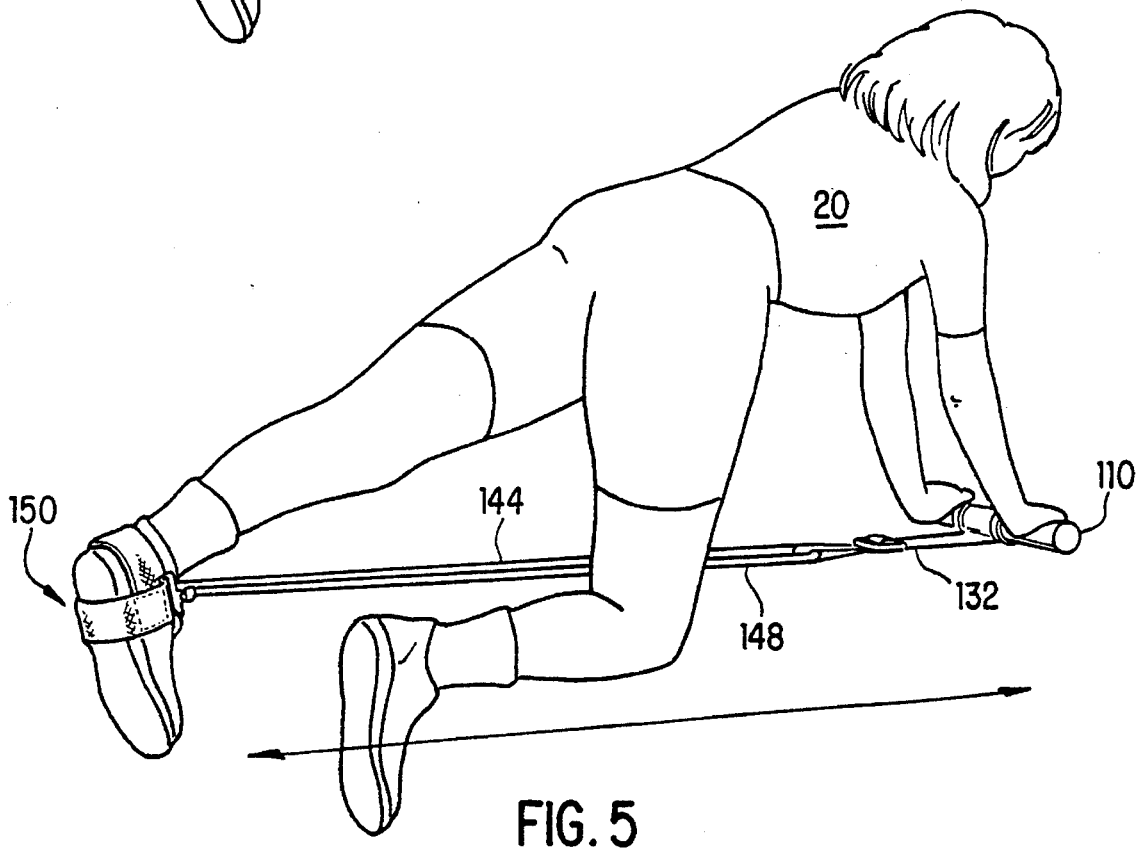
Figure 8:
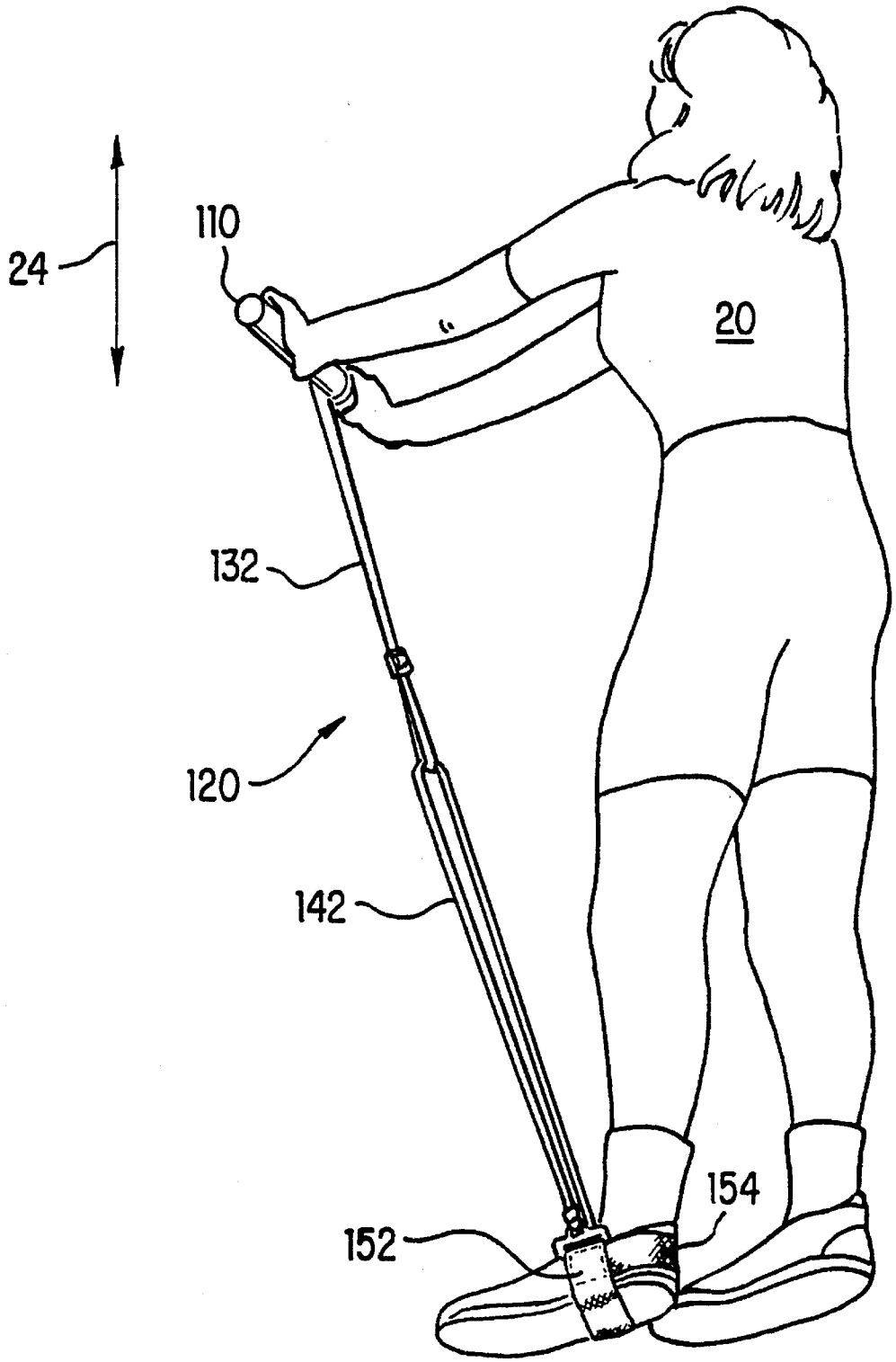

In a typical application, as shown in FIGS. 4 and 5, the user 20 utilizes her hands to grasp and maintain the position of handle 110. The inelastic strap member 132 is adjusted to a predetermined length in order to provide an initial tension on the respective extendable sections 144, 148 of the elastic strap member 142. The user then thrusts their leg outwardly, displacing the heel engagement assembly 150 with respect to handle member 110, thereby stretching the extendable sections 144, 148 and increasing the resistive force provided thereby. Subsequently, the user 20 relaxes her leg, bringing it back to the initial position followed by subsequent extensions and relaxation steps. Obviously, a user may maintain the position of the heel engagement assembly and displace the handle 110 relative thereto for exercising upper body muscles, as shown in FIG. 8. Such multipurpose functionality is provided by the ability to adjust the overall length of the resistive force assembly 120 to provide a desired initial length. The user may then displace handle 110 up and down, as indicated by directional arrow 24. While the length adjustment of the inelastic strap member 132 provides a convenient means for providing an initial displacement dimension of the heel engagement assembly 150 relative to the handle member 110, which in turn provides for adjustment of an initial resistive force, the adjustability of strap member 132 provides other important advantages when particular exercises are performed.

Figure 6:
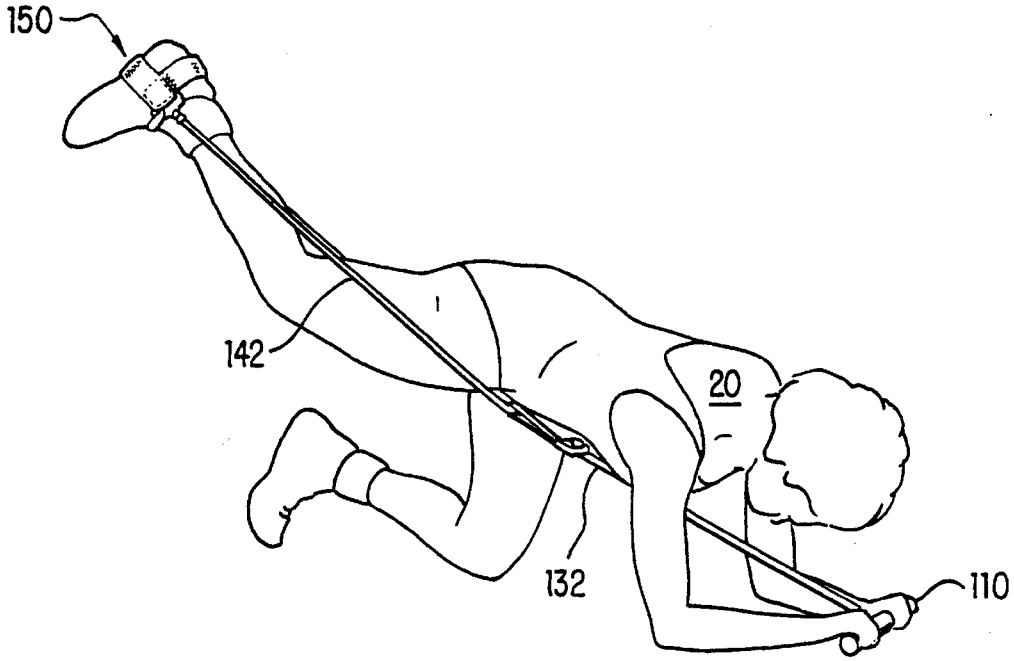

When a user is performing a leg curl type exercise, as shown in FIG. 6, wherein the user's leg is raised high above the user's body, the resistive force assembly 120 extends upwardly from handle member 110 to the heel engagement assembly 150. Under these circumstances, the resistive force assembly 120 comes in close proximity to, or in contact with, the upper torso of the user 20 during a significant portion of the exercise. During such an exercise program, it is desirable to adjust the length of inelastic strap member 132 such that it is strap member 132 which comes in proximity or contacts the user's torso, as opposed to the elastic strap member 142. By this arrangement, injury or chafing which would otherwise result from abrasion is avoided. Since the portion of resistive force assembly 120, namely the elastic member 142, which is elongated and relaxed during the exercise is not brought into contact with the user's torso, abrasive type injury to the user is avoided. Further, the provision of the third band member 156 of heel engagement assembly 150 insures that that assembly will not slip off the user's foot, thereby further avoiding the potential for painful injury.

Figure 7:
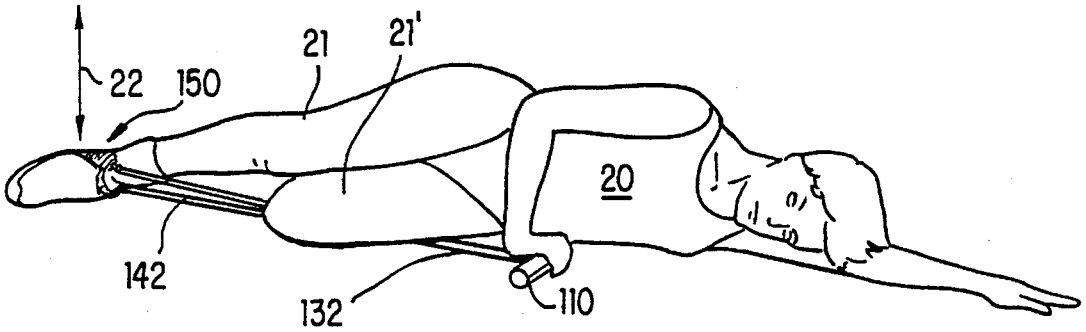

Other exercise modes, as shown in FIG. 7, require that the user extend one leg 21 in a direction indicated by directional arrow 22, against a laterally applied resistive force. Such resistive force is applied safely by the user positioning her other leg 21' on the inelastic strap member 132, adjacent the second end thereof, in combination with securing the position of handle 110 with at least one of the user's hands. The user then raises and lowers the leg 21 in the direction indicated by directional arrow 22, without creating abrasive displacement of the portion of the resistance assembly being maintained under the user's leg 21'. Further, the total encompassing of the tarsal portion of the user's foot by the three strap members 152, 154 and 156 provides a secure attachment thereto, irrespective of the direction in which the user's foot is displaced.

It can thus be seen that system 100, by virtue of its novel structure, provides particular advantages over prior art systems intended to exercise lower body muscle groups. In particular, the structure of the heel engagement assembly 150 locates the resistive force supplied by resistive force assembly 120 in substantial alignment with a user's ankle and load bearing axis of the user's leg, allowing the resistive forces to be applied to the user's leg muscles without creating potentially injurious torques on the user's ankle and knee joints. Further, the structure of the resistive force assembly 120 further adds to the safety and effectiveness of system 100.

The length adjustment feature of resistive force assembly 120 advantageously provides the ability to use system 100 for both upper and lower body exercises, as well as providing a means to adjust the resistive force being provided thereby. In addition to providing for adjustment of the resistive force against which the user will exercise, inelastic strap member 132 defines a portion of the resistive force assembly 120 which may safely come in contact with the user's body. By virtue of its inelasticity, strap member 132 is able to be in contact with the user's body without causing abrasive injury thereto. Injury to the user is further avoided by applying the resistive force in a balanced manner, the resistive loading being equally divided between opposing sides of a user's leg. Such is accomplished by coupling opposing ends of the elastic strap member 142 to the heel engagement assembly 150, wherein an intermediate section 146 of the elastic strap member 142 is slidingly coupled to the closed contoured end 136 of inelastic strap member 132, thereby providing substantially equal load forces on the opposing extendable sections 144, 148 of the elastic strap member 142.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as described in the appended Claims.

What is being claimed is:

1. A device for exercising gluteal and thigh muscles, comprising:

a. a longitudinally extended handle member;

b. means for engaging a heel portion of a user's foot, said heel engagement means including a first band member configured and adapted to have a pair of opposing ends extending between opposing sides of a user's foot at an inferior tarsal portion thereof and in substantial alignment with the user's ankle and load bearing axis of the user's leg; and, c. means coupled on a first end to said handle member and on an opposing second end to said heel engagement means for providing a resistive force therebetween, said resistive force means including means for adjusting an initial displacement dimension of said heel engagement means relative to said handle member and an elastic strap member coupled between said adjustment means and said heel engagement means, said adjustment means including a substantially inelastic strap member having a first end secured to said handle member and an opposing second end formed in a closed contour, said elastic strap member having opposing first and second ends respectively coupled to said opposing ends of said first band member and an intermediate section slidingly coupled to said closed contour second end of said inelastic strap member for providing balanced resistive force loading on opposing sides of a user's leg.

2. The exercise device as recited in claim 1 where said heel engagement means further includes a second band member coupled on opposing ends to respective opposing ends of said first band member, said second band member extending in a direction transverse said first band member, said second band member is configured and adapted to engage a posterior heel portion of the user's foot.

3. The exercise device as recited in claim 2 where said heel engagement means further includes a third band member releasably securable between said opposing ends of said first band member and configured and adapted to extend across a superior tarsal portion of a user's foot and thereby substantially maintain said first and second band members' respective engagement with the user's foot.

4. An exercise system for applying a resistive force to gluteal and thigh muscles, comprising:

a. a longitudinally extended handle member;

b. means for engaging a heel portion of a user's foot in substantial alignment with the user's ankle and load bearing axis of the user's leg, said heel engagement means including (1) a first band member configured and adapted to extend across an inferior tarsal portion of a user's foot in substantial alignment with the user's ankle and load bearing axis of the user's leg, and (2) a second band member coupled on opposing ends to respective opposing ends of said first band member, said second band member extending in a direction transverse said first band member and being configured and adapted to engage a posterior heel portion of the user's foot; and, c. resistance means coupled on one end to said handle member and on an opposing end to said heel engagement means for providing a force resistant to displacement of said heel engagement means, said resistance means including (1) inelastic resistive force means coupled on a first end to said handle member, and (2) an elastic strap member having a pair of opposing ends respectively coupled to opposing ends of said first band member and having an intermediate section slidingly coupled to said second end of said inelastic resistive force means for providing balanced resistive force loading on opposing sides of a user's leg.

5. The exercise system as recited in claim 4 where said heel engagement means further includes a third band member releasably securable between said opposing ends of said first band member, said third band member being configured and adapted to extend across a superior tarsal portion of a user's foot and thereby substantially maintain said first and second band members' respective engagement with the user's foot.

6. The exercise system as recited in claim 4 where said inelastic resistive force means includes means for adjusting a length dimension of said inelastic strap member.

* * * * *